US010676109B2

(12) United States Patent
Huck et al.

(10) Patent No.: US 10,676,109 B2
(45) Date of Patent: Jun. 9, 2020

(54) AUTORACK DECK ADJUSTMENTS

(71) Applicant: Trinity North American Freight Car, Inc., Dallas, TX (US)

(72) Inventors: Kenneth Huck, Fairview, TX (US); Christopher C. Harkey, Dallas, TX (US); Lee Reitz, Euless, TX (US); Kyle R. Coston, Forney, TX (US)

(73) Assignee: Trinity North American Freight Car, Inc., Dallas, TX (US)

( * ) Notice: Subject to any disclaimer, the term of this patent is extended or adjusted under 35 U.S.C. 154(b) by 369 days.

(21) Appl. No.: 15/797,740

(22) Filed: Oct. 30, 2017

(65) Prior Publication Data

US 2018/0118229 A1 May 3, 2018

Related U.S. Application Data

(60) Provisional application No. 62/415,766, filed on Nov. 1, 2016.

(51) Int. Cl.
*B61D 3/18* (2006.01)

(52) U.S. Cl.
CPC ..... *B61D 3/187* (2013.01); *B61D 3/18* (2013.01)

(58) Field of Classification Search
CPC ..... B61D 3/18; B61D 3/187; B61D 3/005; B61D 3/02; B61D 3/04; B60P 1/02; B60P 3/08; B60P 1/6445; B60P 3/07; B66B 9/025; Y10T 74/18704; B66F 7/025
USPC ..... 74/424.71, 424.78, 424.79
See application file for complete search history.

(56) References Cited

U.S. PATENT DOCUMENTS 1,083,831 A * 1/1914 Holdaway ..... B61D 3/163 105/370
4,149,430 A * 4/1979 F'Geppert ..... F16H 25/2204 74/89.39
5,938,382 A * 8/1999 Andre ..... B60P 3/08 187/214

FOREIGN PATENT DOCUMENTS

EP 0 322 329 * 6/1989
GB 2 044 216 * 10/1980

* cited by examiner

*Primary Examiner* — Mark T Le
(74) *Attorney, Agent, or Firm* — Baker Botts, LLP

(57) ABSTRACT

An apparatus includes a latch and a travelling nut. The latch couples to a deck of an auto rack car. The latch includes a body coupled to a hinge such that the body may rotate about the hinge from a first position to a second position. The body includes a key. The travelling nut engages a ball screw. The travelling nut includes a slot. The travelling nut rotates with the ball screw when the body is in the first position. The key engages the slot when the body is in the second position. The travelling nut and the latch adjust a height of the deck in the auto rack car when the body is in the second position and when the ball screw is turned.

4 Claims, 8 Drawing Sheets

AUTORACK DECK ADJUSTMENTS

CROSS REFERENCE TO RELATED APPLICATIONS

This application claims the benefit of U.S. Provisional Application Ser. No. 62/415,766, entitled "Autorack Deck Adjustments," which was filed Nov. 1, 2016, the entire contents of which are incorporated herein by reference.

TECHNICAL FIELD

This disclosure relates generally to configuring an Auto Rack car.

BACKGROUND

Auto Rack cars (also referred to as autorack cars) are a type of railcar configured to store and transport automobiles and/or vehicles (e.g., cars, trucks, motorcycles, etc.). Existing Auto Rack cars may be configured with one deck, (Uni-level), two decks, (Bi-level), or three decks, (Tri-level). Deck heights determine the maximum height of auto vehicles the Auto Rack deck can transport. Deck heights are generally set and not moved due to difficulty and expense. Deck adjustments may be performed at a distant facility, which requires scheduling and having the Auto Rack car out of service for the duration of the conversion. These adjustments may increase the expense to the shipper and limits the flexibility of the shipper to manage loading efficiency. These adjustments may also require careful scheduling of Auto Rack cars with the correct deck heights to accommodate a given shipment. Further, in order for an Auto Rack car to be compatible with other Auto Rack cars, the decks may have to be located in certain positions or within some tolerance (e.g. plus or minus 3 inches) of the other Auto Rack cars.

SUMMARY

This disclosure contemplates an unconventional coupler that assists in adjusting the height of a deck in an auto rack car. The coupler allows the deck to couple to an adjustment mechanism (e.g., a ball screw) that can adjust the height of the deck. When the deck is repositioned, the coupler allows the deck to decouple from the adjustment mechanism. Several designs for the coupler are contemplated in this disclosure. Various embodiments are described below.

According to an embodiment, an apparatus includes a latch and a travelling nut. The latch couples to a deck of an auto rack car. The latch includes a body coupled to a hinge such that the body may rotate about the hinge from a first position to a second position. The body includes a key. The travelling nut engages a ball screw. The travelling nut includes a slot. The travelling nut rotates with the ball screw when the body is in the first position. The key engages the slot when the body is in the second position. The travelling nut and the latch adjust a height of the deck in the auto rack car when the body is in the second position and when the ball screw is turned.

According to another embodiment, an apparatus includes a deck of an auto rack car and a travelling nut. The travelling nut is coupled to the deck. The travelling nut includes a first portion and a second portion. The first and second portions may move towards a ball screw to engage the ball screw and may move away from the ball screw to disengage the ball screw. The travelling nut adjusts a height of the deck in the auto rack car when the first and second portions are engaged with the ball screw and when the ball screw is turned.

According to yet another embodiment, an apparatus includes a travelling nut, a link, and a pin. The travelling nut engages a ball screw. The link is coupled to the travelling nut. The pin couples the link to a deck of an auto rack car such that the travelling nut adjusts a height of the deck in the auto rack car when the ball screw is turned.

According to another embodiment, a method includes aligning a slot in a travelling nut with a key of a body of a latch, rotating the latch such that the key engages the slot, and rotating a ball screw such that the travelling nut and the latch adjust a height of a deck in an auto rack car.

Certain embodiments provide one or more technical advantages. For example, an embodiment includes an unconventional coupler that allows a deck in an auto rack car to be repositioned without the need for tools. As another example, an embodiment includes a coupler that allows a deck in an auto rack car to be repositioned without having to remove the deck from the auto rack car. In some embodiments, a coupler allows for decks in an auto rack car to be repositioned independently of one another. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
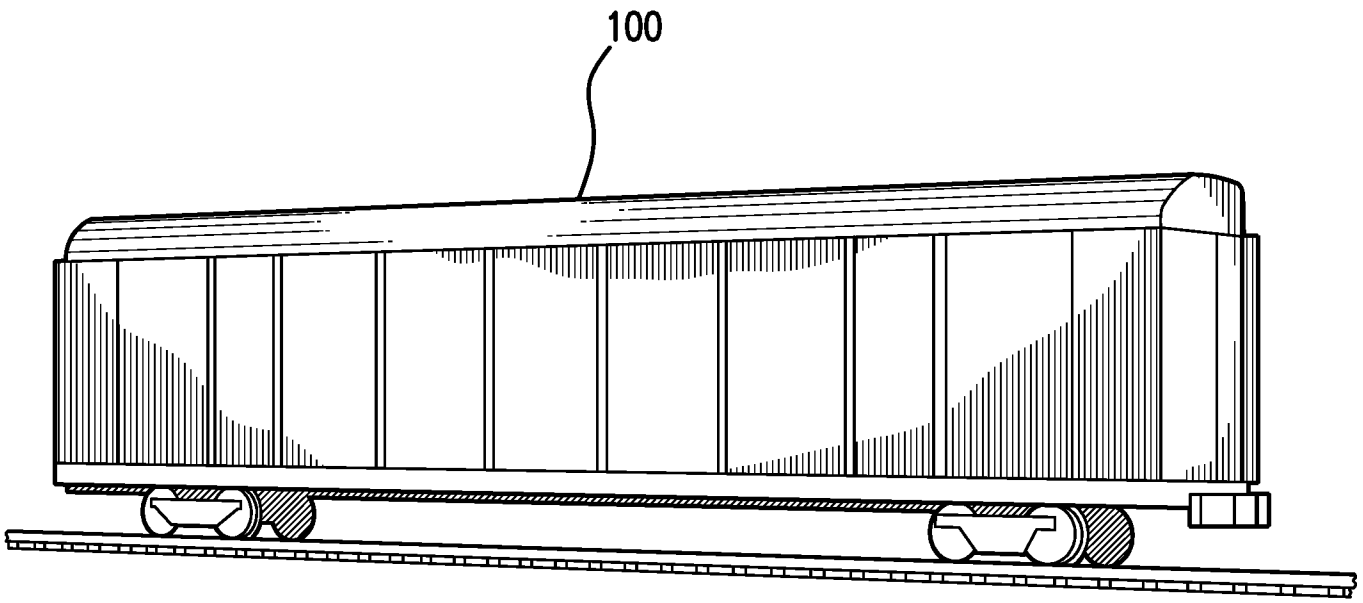
FIG. 1A is a side view of an embodiment of an Auto Rack car.
Figure 1B:
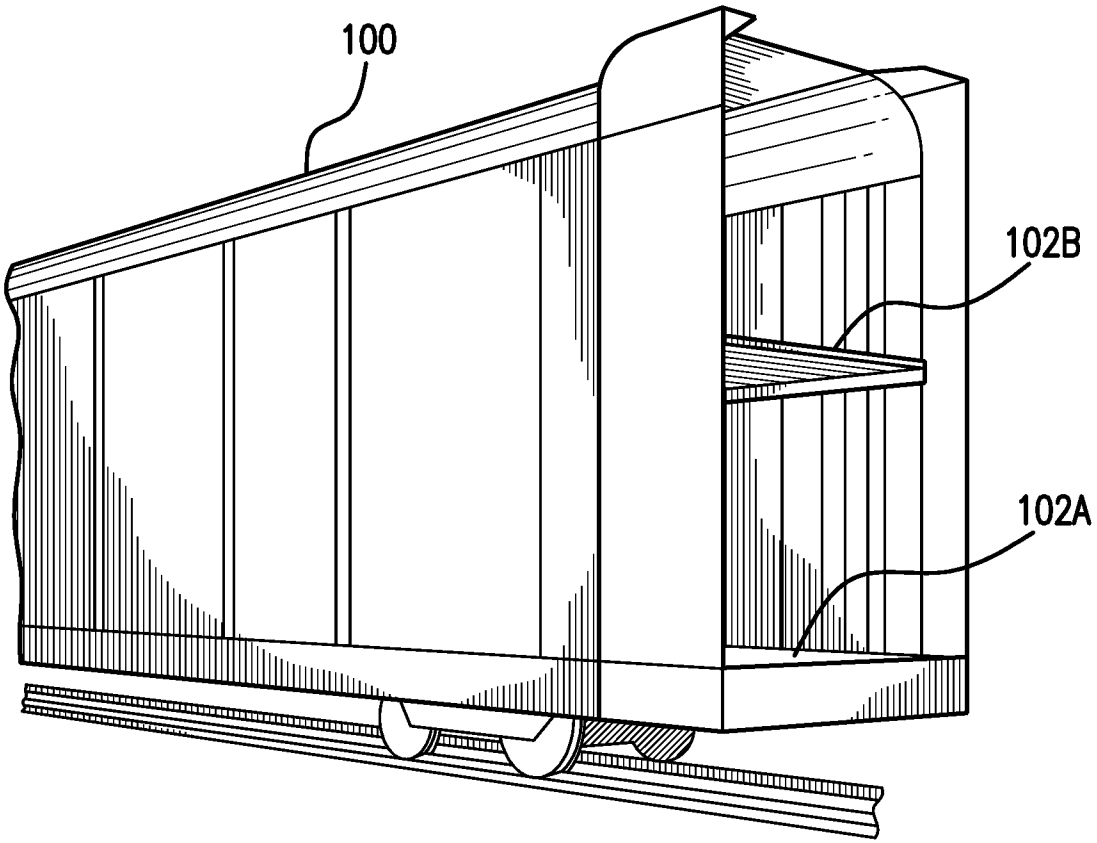
FIG. 1B is an end view of an embodiment of an Auto Rack car.

Auto Rack cars are a type of railcar used to store and transport vehicles (e.g., cars, trucks, motorcycles, etc.). FIG. 1A illustrates a side view of an embodiment of an Auto Rack car 100. Vehicles are loaded into the Auto Rack car 100 and transported by railway to their destination. Existing Auto Rack cars 100 may contain decks at different heights on which vehicles can be stored. By using these decks, more vehicles can be loaded into an Auto Rack car 100. FIG. 1B illustrates an end view of an embodiment of an Auto Rack car 100. In the illustrated embodiment of FIG. 1B, Auto Rack car 100 includes two decks 102A and 102B. This disclosure contemplates Auto Rack car 100 including any number of decks (e.g. three or more decks). The decks of an Auto Rack car may be referred to as an A-deck, a B-deck, a C-deck, and so forth based on their position with the Auto Rack car. The floor or lowest level of the Auto Rack car is referred to as the A-deck (labeled 102A in FIG. 1A). The level or deck above the A-deck is the B-deck (labeled 102B in FIG. 1A). The level or deck above the B-deck is the C-deck, and so forth.

In existing Auto Rack cars, once the decks are positioned in the Auto Rack car, the decks may be difficult to remove and/or adjust. Furthermore, it may also be difficult to adjust a height of the existing Auto Rack cars. This disclosure contemplates an unconventional coupler that allows for decks in an auto rack car to couple and uncouple from an adjustment mechanism (e.g., a ball screw). The coupler is used to couple the deck to the adjustment mechanism when the deck needs to be repositioned. After the deck is repositioned, the coupler can be used to uncouple the deck from the adjustment mechanism. By using the coupler, it may not be necessary to use tools to reposition the decks in an auto rack car in certain embodiment. In some embodiments, the coupler may allow decks to be repositioned independently of one another and/or without removing the decks from the auto rack car.

Disclosed herein are various embodiments for configuring decks in an Auto Rack car 100. An Auto Rack car 100 may be configured or reconfigured for different vehicles by adjusting the vertical position of decks within the Auto Rack car 100.

In one embodiment, the vertical position of decks in an Auto Rack car 100 may be adjusted without disassembling portions of the Auto Rack car 100. Each deck may be raised or lowered within the Auto Rack car 100 to accommodate a variety of load combinations. The ability to adjust the vertical position of decks in an Auto Rack car 100 may permit a shipper to easily adjust deck heights to maximize loading efficiency without having to move the Auto Rack car 100 into a maintenance shop, and may provide a means to adjust deck heights to match that of an adjacent Auto Rack car 100 making Auto Rack cars 100 with this design compatible.

Figure 1C:
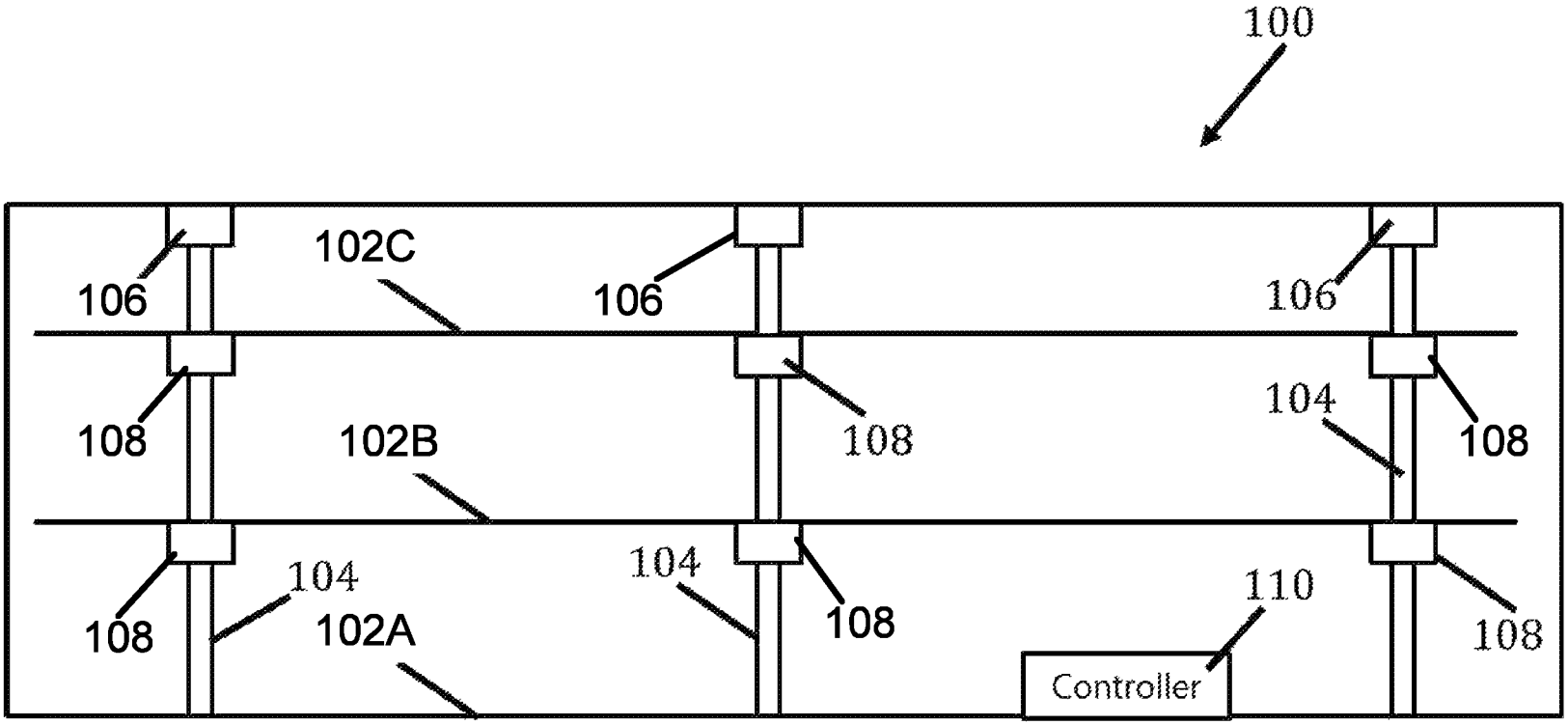
FIG. 1C is a cutaway side view of an embodiment of an Auto Rack car with repositionable decks.

FIG. 1C is a cutaway side view of an embodiment of an Auto Rack car 100 with repositionable decks 102B and 102C. In one embodiment, the Auto Rack car 100 is configured to allow the deck heights to be easily and quickly adjusted by incremental amounts using an adjustment system without having to move the Auto Rack car 100 to a maintenance shop, without having to remove decks 102B and 102C from Auto Rack car 100, and/or without using tools, pins, or fasteners. The vertical position of decks 102B and 102C with respect to the Auto Rack car 100 may be adjusted incrementally, for example, within plus or minus 3 inches, while maintaining pool compatibility and providing an extra clearance (e.g. one or two inches) where needed to accommodate vehicles of different heights. Decks 102B and 102C may be adjusted to heights which allow the Auto Rack car 100 to be compatible with deck heights of other Auto Rack cars in the same train. In one embodiment, a deck 102B or 102C may be "unlocked" (e.g. unbolted or mechanically uncoupled) from the side structure of the Auto Rack car 100, repositioned to a new position, and "relocked" (e.g. bolted or mechanically coupled) to the side structure of the Auto Rack car 100. When deck 102B or 102C is locked to the side structure of the Auto Rack car 100, a vertical position of the deck 102B or 102C within the Auto Rack car 100 cannot be adjusted. Decks 102B or 102C may be supported and/or repositioned by a variety of techniques, including, but not limited to, cranes, hoists, jacks, chain/cable hoists, hydraulic or air cylinders, and levers.

A vertical position of deck 102A may be adjusted using similar processes to adjust a vertical position of deck 102B or 102C in particular embodiments. In some embodiments, deck 102A is a floor of Auto Rack car 100 and a vertical position of deck 102A cannot be adjusted. In some embodiments, a vertical position of deck 102A can be adjusted.

In one embodiment, the adjustment system may be a Ball screw system that includes Ball screws 104 (or ACME thread in certain embodiments), Ball screw actuators 106, a coupler 108, and a controller 110. A Ball screw actuator 106 may be attached to the roof section of the Auto Rack car 100 and may be controlled by controller 110. The controller 110 is operably coupled to the Ball screw actuator 106, and is configured to communicate electrical signals for positioning decks 102B and 102C. The Ball screw 104 is operably coupled to the Ball screw actuator 106 and configured to be rotated by the Ball screw actuator 106 through a gear reduction mechanism and an electric motor or any other rotational system. The coupler 108 may be operably coupled to deck 102B or 102C and Ball screw 104 and configured to move along the Ball screw 104 when the Ball screw 104 is turned. The direction of travel of the coupler 108 depends upon the direction the Ball screw 104 is turned. Using the Ball screw 104 and coupler 108, the deck 102B and 102C can be moved anywhere along the Ball screw 104. The position of the deck 102B or 102C may only be limited by the length of the Ball screw 104 and the clearances within the Auto Rack car 100. This disclosure contemplates coupler 108 being located above, below, or both above and below a deck 102.

Deck 102B or 102C may be held in position by a brake on the Ball screw 104 and/or a locking system between the deck 102B or 102C and the side structure of the Auto Rack car 100. Multiple Ball screw systems may be used to provide enough lifting capacity, redundancy, and to maintain the deck level during movement. In one embodiment, the deck 102B or 102C may be comprised of multiple sections that can be moved individually or in unison (e.g., a vertical position of one portion of deck 102B or 102C may be adjusted independently of a vertical position of another portion of deck 102B or 102C). The Ball screw system may be configured to reposition a deck 102B or 102C while the deck 102B or 102C is unloaded or loaded, for example, with a vehicle.

A Ball screw system may comprise any number of Ball screws 104 and couplers 108. For example, in one embodiment each deck 102B or 102C may be configured to couple with four Ball screws 104 and four couplers 108 with a Ball screw 104 and a coupler 108 at each corner of the deck 102B or 102C. In another embodiment, each deck 102B or 102C may be configured to couple with six Ball screws 104 and six couplers 108 with a Ball screw 104 and a coupler 108 at each corner of the deck 102B or 102C and a pair of Ball screws 104 and couplers 108 supporting a mid-portion of the deck 102B or 102C. The Ball screws 104 and couplers 108 may be positioned anywhere along the deck and any suitable configuration of Ball screws 104 and couplers 108 may be employed as would be appreciated by one of ordinary skill in the art upon viewing this disclosure.

In order to move autorack decks vertically inside the railcar, some form of attachment (e.g., a coupler) between the decks and the ball screw system should be employed. To move both decks independently from each other, a coupler may attach to the deck being moved and a coupler may be detached from the deck not being moved. Further, to reduce the time used to adjust decks, the coupler may be attached and/or detached quickly and easily.

This disclosure contemplates particular designs for coupler 108 that allow for easy adjustment of deck 102B or 102C. For example, certain designs for coupler 108 allow adjustment of deck 102B or 102C without using tools. As another example, certain designs for coupler 108 allow adjustment of deck 102B or 102C without having to remove deck 102B or 102C from the auto rack car. Certain designs allow adjustment of deck 102B or 102C without using fasteners or pins. Additionally, certain designs protect components of coupler 108 from theft. Furthermore, certain designs allow for independent adjustment of different decks in a railcar. This disclosure contemplates any number of decks of a railcar using coupler 108 to allow for vertical adjustment of the decks. Designs and uses for coupler 108 will be described using FIGS. 2 through 5.

Figure 2:
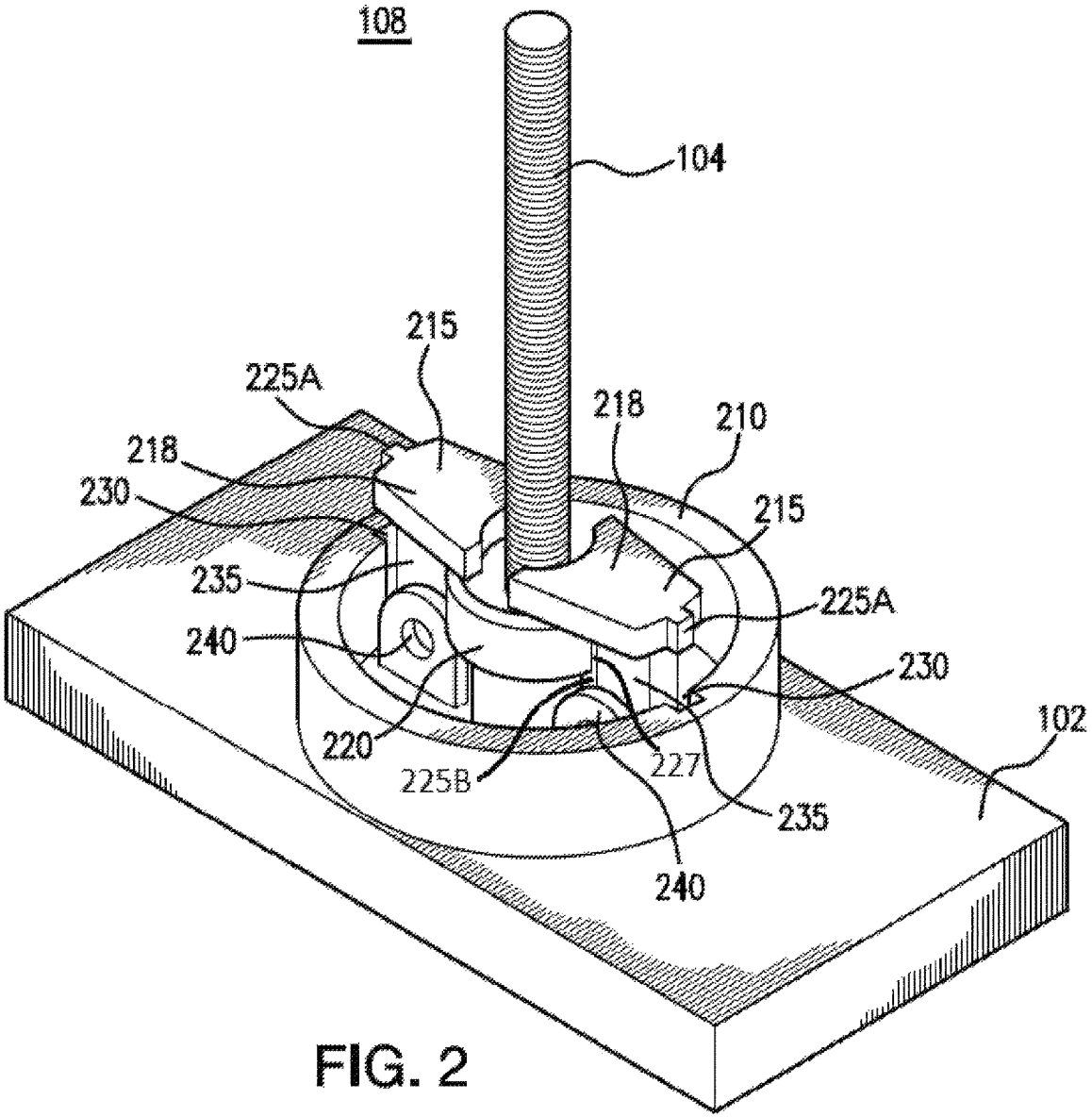
FIG. 2 illustrates an example coupler used to position a deck.

FIG. 2 illustrates an example coupler 108 used to position a deck 102. As illustrated in FIG. 2, ball screw 104 extends through deck 102 and coupler 108. Coupler 108 may be attached to ball screw 104 to allow for vertical adjustment of deck 102. Coupler 108 may be detached from ball screw 104 to prevent vertical adjustment of deck 102. FIG. 2 shows a configuration where coupler 108 is attached to ball screw 104.

Coupler 108 includes a collar 210, one or more latches 215, and a travelling nut 220. Ball screw 104 extends through travelling nut 220. When coupler 108 is detached from ball screw 104, ball screw 104 can rotate without moving deck 102. Travelling nut 220 is stored slightly above (and/or below) deck 102 and due to friction between travelling nut 220 and ball screw 104, when ball screw 104 is turned, travelling nut 220 spins with ball screw 104 and no vertical motion of travelling nut 220 takes place. Latches 215 and collar 210 are stored below (and/or above) travelling nut 220.

Latches 215 include a headpiece 218, a body 235, and a hinge 240. Headpiece may be coupled to body 235, and body 235 may be coupled to deck 102 via hinge 240. Hinge 240 may allow for headpiece 218 and body 235 to rotate outward around hinge 240 from a vertical position (as shown in FIG. 2) to a horizontal position lying on deck 102, and vice versa. When latches 215 are in the vertical position, coupler 108 is considered locked to ball screw 104. When latches 215 are in the horizontal position, coupler 108 is considered "unlocked" from ball screw 104.

Collar 210 encircles latches 215 when latches 215 are in the vertical position and prevent latches 215 from rotating outwards to the unlocked position. Collar 210 may be lifted above latches 215 so that latches 215 may rotate outward to the unlocked position. Collar 210 may also be rotated. In this manner, collar 210 may lock and/or unlock latches 215.

Latches 215 include one or more keys 225A and 225B. As shown in FIG. 2, each headpiece 218 includes a key 225A. Each body 235 also includes a key 225B. Key 225A that forms a portion of headpiece 218 corresponds with a slot 230 in collar 210. In order to lift collar 210 above latches 215, key 225A of headpiece 218 should be aligned with slot 230 in collar 210. If collar 210 is rotated so that key 225A is not aligned with slot 230, then collar 210 cannot be lifted above latches 215.

Key 225B of body 235 engages a corresponding slot 227 of travelling nut 220 when latch 215 is in the locked position. When engaged, key 225B prevents travelling nut 220 from rotating freely with ball screw 104. As a result, when ball screw 104 is turned, vertical movement of travelling nut 220 along ball screw 104 occurs. When key 225B of body 235 is not engaged with the corresponding slot 227 of travelling nut 220, travelling nut 220 is allowed to rotate freely with ball screw 104 as described above.

As an example operation, when it is desired to move deck 102 vertically, collar 210 is lifted. In order to do so, slots 230 in the collar are aligned with keys 225A in each headpiece 218 in order for collar 210 to go past latches 215. Collar 210 is lifted above travelling nut 220 and both latches 215 are rotated outwards to the unlocked position. While holding travelling nut 220, ball screw 104 is turned in a direction that causes nut 220 to move towards deck 102 and coupler 108. This motion is continued until nut 220 contacts deck 102 and/or coupler 102, and then ball screw 104 motion is stopped. Nut 220 is then turned by hand to align the slots 227 in nut 220 with keys 225B of body 235 of each latch 215. Latches 215 are then rotated up towards the locked position such that keys 225B of body 235 engage slots 227 of nut 220. Collar 210 is lowered over latches 215 and nut 220, aligning slots 230 of collar 210 with keys 225A of headpieces 218, and lowered down to rest on deck 102. This process is repeated for all ball screw-to-deck attachments for the portion of deck 102 that is desired to move.

Deck 102 is then uncoupled from the autorack car. Ball screws 104 are then rotated to move deck 102 in the desired direction. Deck 102 is then coupled back to the autorack car. Then, collar 210 may be lifted and latches 215 may be moved to the unlocked position to disengage coupler 108 from ball screw 104. Specifically, collar 210 is lifted over latches 215 by aligning slots 230 with keys 225A on headpieces 218 of latches 215. This allows latches 215 to be rotated away from ball screw 104 to the unlocked position. Holding on to travelling nut 220, ball screw 104 is rotated in the direction that moves nut 220 above (and/or below) deck 102 and/or coupler 108. Latches 215 are rotated to the vertical position and collar 210 is lowered over latches 215 to the stored position. This process is repeated for all ball screw-to-deck attachments.

In certain embodiments, by using coupler 108, it may not be necessary to use tools to reposition deck 102 in the railcar 100. In some embodiments, coupler 108 allows deck 102 to be repositioned independent of other decks 102 in railcar 100. Furthermore, in some embodiments, collar 210 may prevent or hinder theft of certain components of coupler 108 by making it more difficult to remove these components when collar 210 is resting on deck 102.

Figure 3:
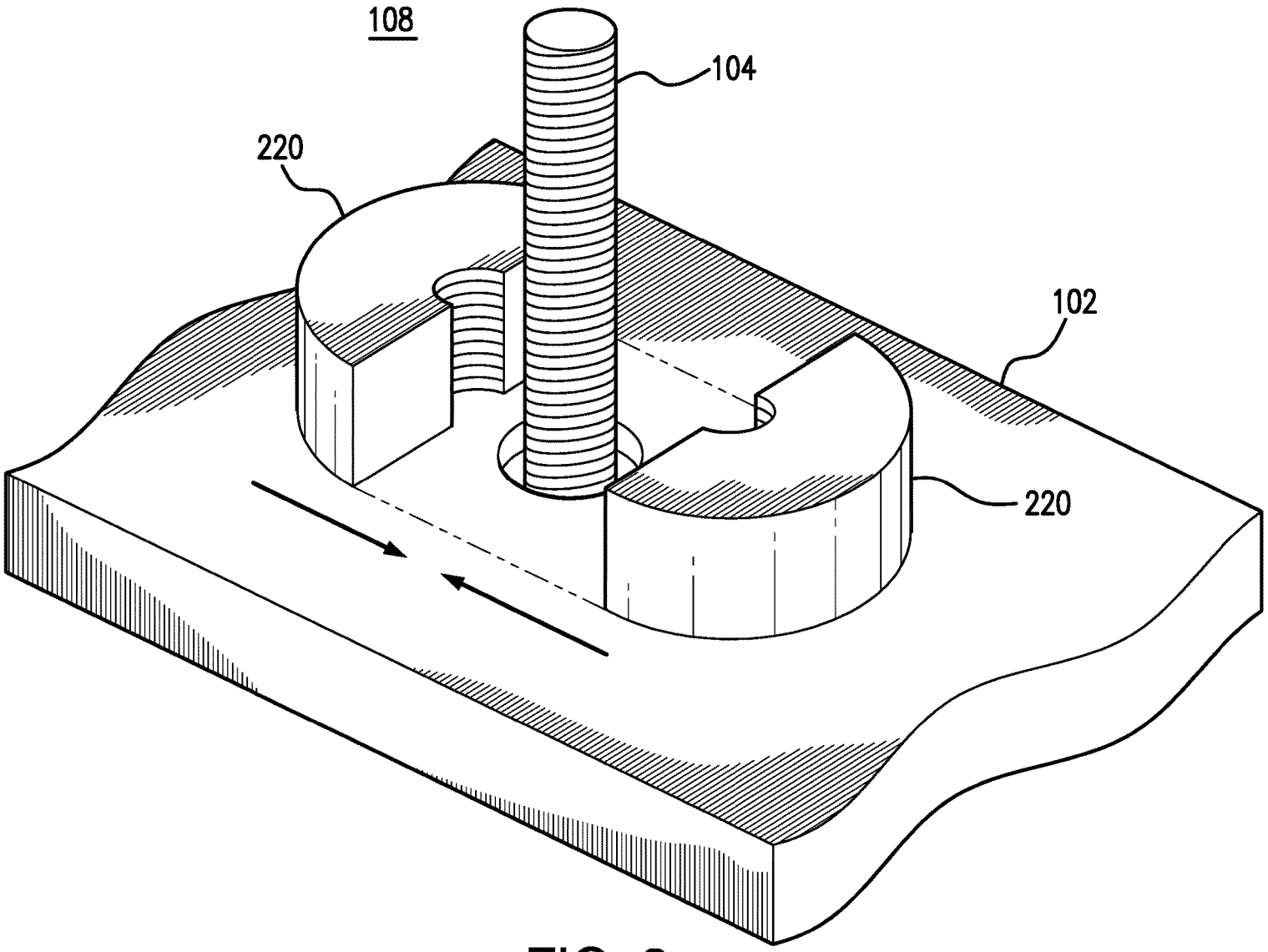
FIG. 3 illustrates an example coupler used to position a deck.
Figure 4:
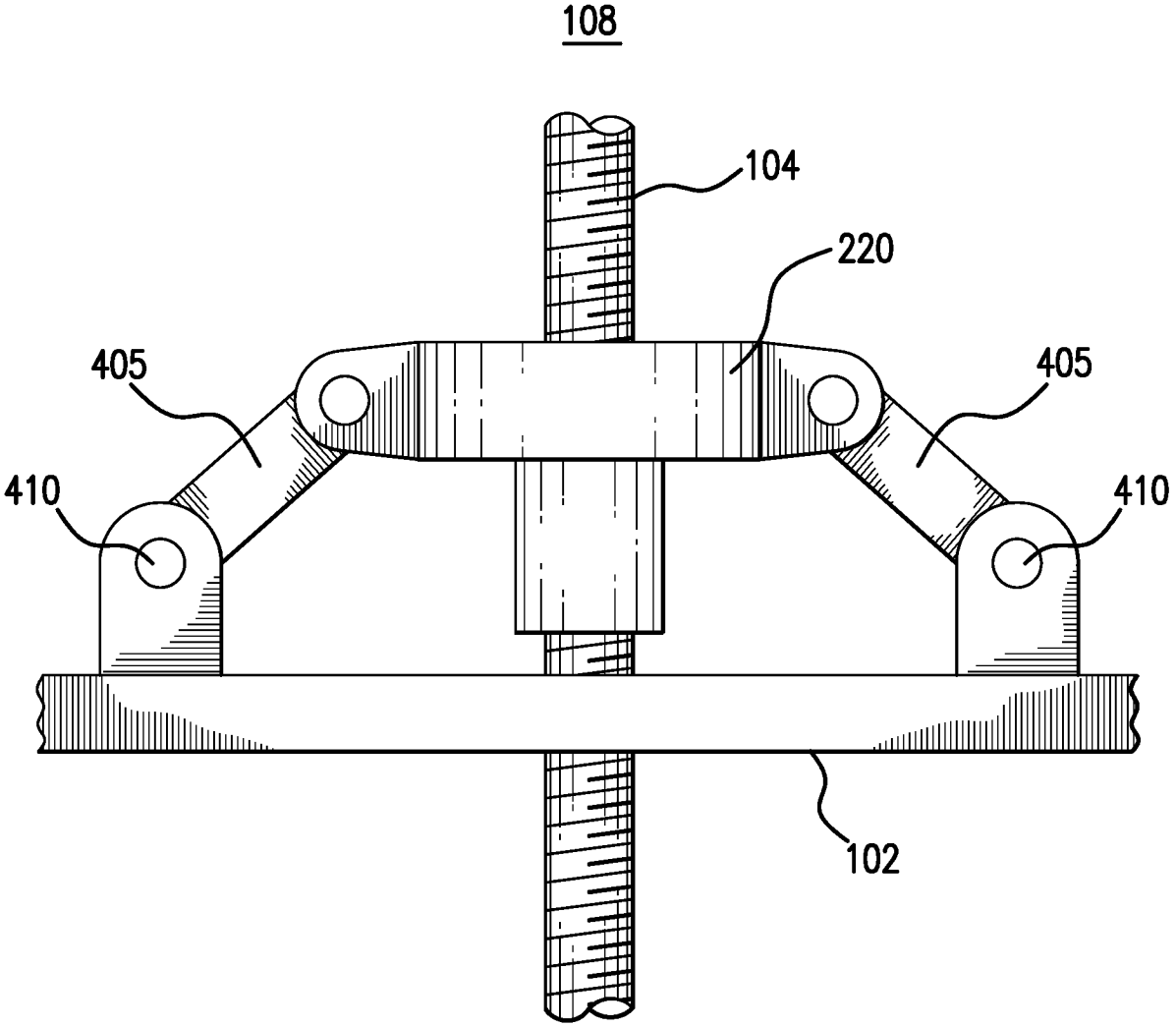
FIG. 4 illustrates an example coupler used to position a deck.

Other designs for coupler 108 are contemplated and described using FIGS. 3 and 4. Like the design described above, these designs also allow deck 102 to couple and uncouple from ball screw 104.

FIG. 3 illustrates an example coupler 108 used to position a deck 102. As shown in FIG. 3, the travelling nut 220 may be permanently attached to the deck and a mechanism is used to engage the nut 220 to the ball screw 104 threads. For example, a split nut may 220 be separated and each half 220 moved along a track away from the ball screw 104 to disengage from the ball screw 104 threads. The two halves 220 may be moved back towards the ball screw 104 along those tracks and then clamped together around the ball screw 104 to engage the ball screw 104 threads. Turning the ball screw 104 then causes the nut 220 to move vertically along the ball screw 104, which adjusts the vertical position of the deck 102. This disclosure contemplates any mechanism by which the halves 220 of the travelling nut 220 move toward or away from the ball screw 104. Additionally, this disclosure contemplates any mechanism to lock/clamp the travelling nut 220 halves to the ball screw 104. In certain embodiments, by using coupler 108, it may not be necessary to use tools to reposition deck 102 in the railcar 100. In some embodiments, coupler 108 allows deck 102 to be repositioned independent of other decks 102 in railcar 100.

FIG. 4 illustrates an example coupler 108 used to position a deck 102. As shown in FIG. 4, links 405 and pins 410 may be used to connect the deck 102 being moved to the travelling nut 220. This may be a direct connection or may include one or more other members between the connection. As an example operation, the links 405 may be unlinked/unlocked from the deck 102. The links 405 may be held while the ball screw 104 is turned to move the travelling nut 220 (and the links 405) closer to the deck 102. The links 405 may then be coupled to the deck 102 by pins 410 and the ball screw 104 may be turned to cause the travelling nut 220 and the deck 102 to move along the ball screw 104. When the deck 102 is in the desired position, the pins 410 may be removed and the travelling nut 220 unlinked/unlocked/disengaged from the deck 102. In certain embodiments, by using coupler 108, it may not be necessary to use tools to reposition deck 102 in the railcar 100. In some embodiments, coupler 108 allows deck 102 to be repositioned independent of other decks 102 in railcar 100.

This disclosure contemplates any number of travelling nuts used in a coupler 108. For example, two travelling nuts may be used in a coupler, one above and one below the deck, to capture the deck for movement.

In some embodiments, a cable and pulley system may be used to adjust the vertical position of a deck instead of a ball screw system. Friction locks (rather than travelling nuts) may be used to "lock" the deck to the cable. The cable may then be pulled or released to adjust the vertical position of the deck. Then, the friction lock may be unlocked. One end of the cable may be attached above the deck and the other end attached below the deck. The cable may be run through a pulley that is attached to a deck being moved and disconnected from a deck not being moved.

Figure 5A:
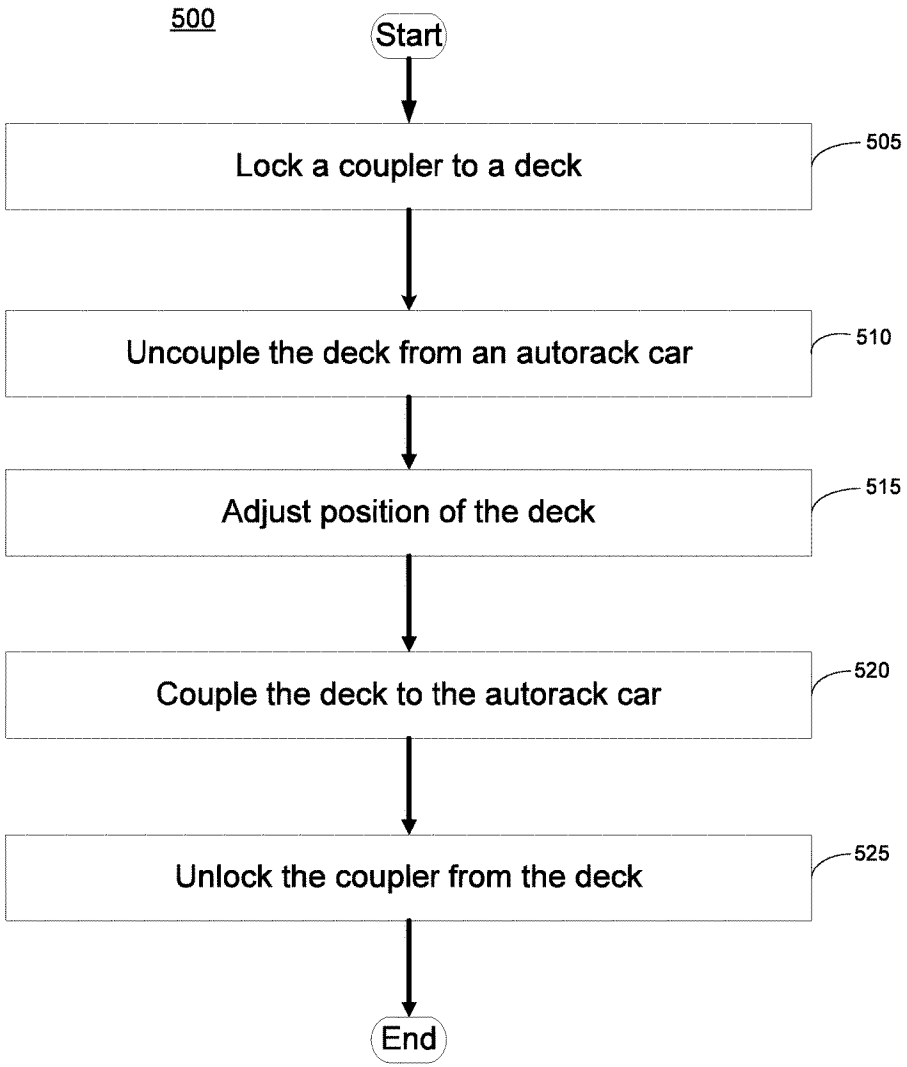
FIG. 5A is a flowchart illustrating a method of positioning a deck.

FIG. 5A is a flowchart illustrating an example method 500 of positioning a deck. In particular embodiments, an operator of an autorack railcar may perform method 500. In step 505, the operator may lock a coupler to a deck. In step 510, the operator may uncouple the deck from an autorack car. The operator may adjust a position (e.g., vertical position) of the deck in step 515. In step 520, the operator may couple the deck back to the autorack car. The operator may then unlock the coupler from the deck in step 525.

Figure 5B:
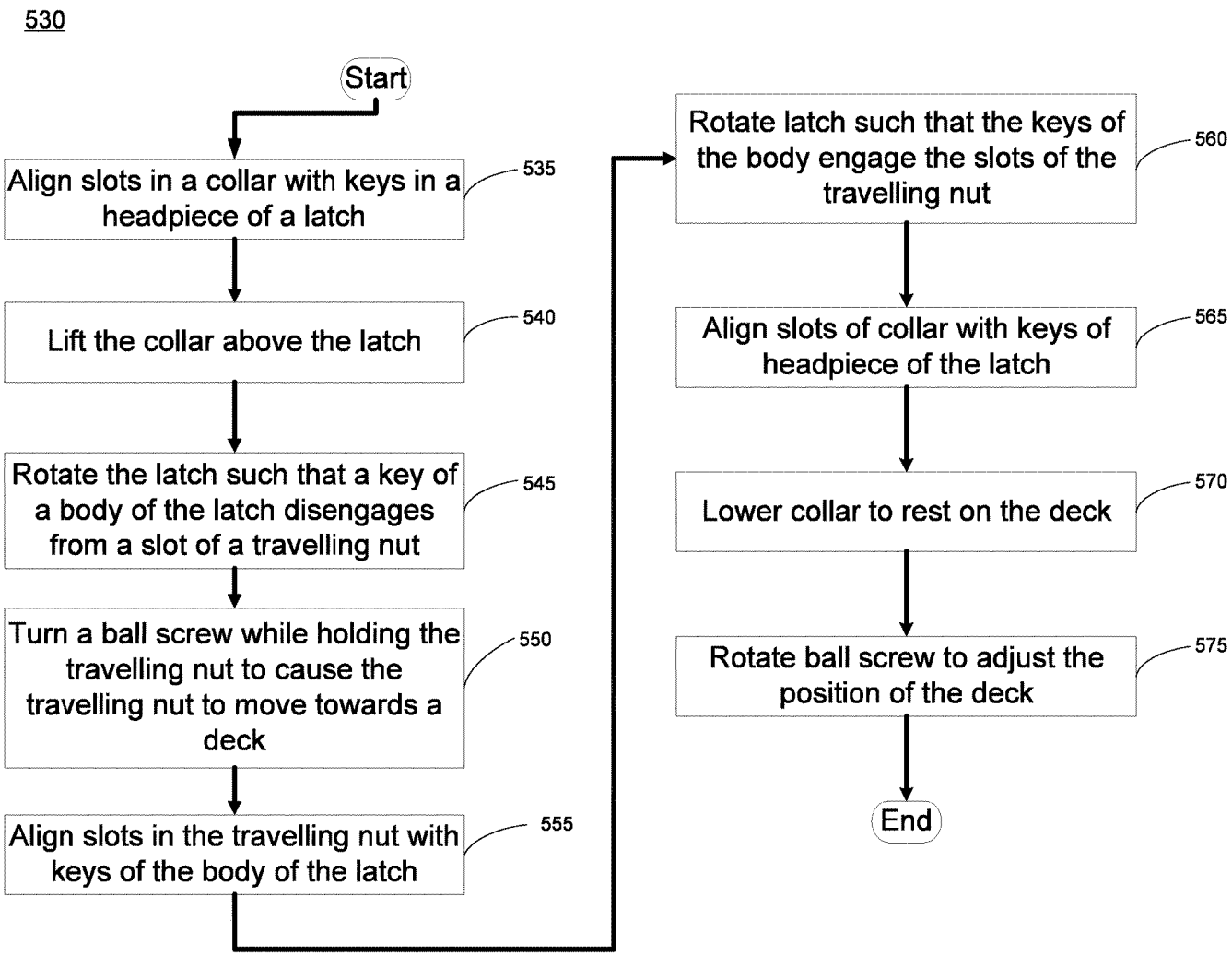
FIG. 5B is a flowchart illustrating a method of positioning a deck.

FIG. 5B is a flowchart illustrating an example method 530 of positioning a deck. In certain embodiments, an operator of an autorack railcar may perform method 530. In step 535, the operator aligns slots in a collar with a key in a headpiece of a latch. The operator then lifts the collar above the latch in step 540. In step 545, the operator rotates the latch such that a key of a body of the latch disengages from a slot of a travelling nut. The operator then turns a ball screw while holding the travelling nut to cause the travelling nut to move towards a deck in step 550. In step 555, the operator aligns slots in the travelling nut with a key of the body of the latch. The operator then rotates the latch such that the key of the body engage the slots of the travelling nut in step 560. In step 565, the operator aligns slots of the collar with the key of the headpiece of the latch. Then, the operator lowers the collar to rest on the deck in step 570. In step 575, the operator rotates the ball screw to adjust the position of the deck.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to methods 500 and 530 depicted in FIGS. 5A and 5B. Methods 500 and 530 may include more, fewer, or other steps. For example, steps may be performed in parallel or in any suitable order. Any suitable component of railcar 100 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 12(f) as it exists on the date of filing hereof unless the words "means for" or "step for" are explicitly used in the particular claim.

What is claimed is:

1. An apparatus comprising:

a latch configured to couple to a deck of an auto rack car, the latch comprising a body coupled to a hinge such that the body may rotate about the hinge from a first position to a second position, the body comprising a key;

a travelling nut configured to engage a ball screw, the travelling nut comprising a slot, the travelling nut configured to rotate with the ball screw when the body is in the first position, the key configured to engage the slot when the body is in the second position, the travelling nut and the latch configured to adjust a height of the deck in the auto rack car when the body is in the second position and when the ball screw is turned: and a collar, the collar comprising a second slot, the collar configured to encircle the latch when the body is in the second position, the latch further comprising a headpiece coupled to the body, the headpiece comprising a second key, the second slot and the second key configured such that the collar may be lifted above the latch when the second slot is aligned with the second key.

2. The apparatus of claim 1, wherein the collar prevents the body from rotating from the second position to the first position.

3. The apparatus of claim 1, further comprising a second latch comprising a second body coupled to a second hinge such that the second body may rotate about the second hinge from a third position to a fourth position, the second body comprising a second key, the travelling nut comprising a second slot, the travelling nut configured to rotate with the ball screw when the second body is in the third position, the second key configured to engage the second slot when the second body is in the fourth position.

4. The apparatus of claim 1, wherein the travelling nut is configured to engage the ball screw such that the ball screw extends through the travelling nut.

* * * * *